US006119910A

United States Patent [19]

Beaudoin

[11] Patent Number: 6,119,910

[45] Date of Patent: Sep. 19, 2000

[54] PUMP PULLER

[76] Inventor: Raymond Beaudoin, Box 313, Gardner Hollow Rd., Poughquag, N.Y. 12570

[21] Appl. No.: 08/821,683

[22] Filed: Mar. 20, 1997

[51] Int. Cl.[7] ..... G03B 1/56; B65H 20/00; B66D 1/00

[52] U.S. Cl. ..... 226/90; 226/177; 226/186; 166/77.51; 254/134.3 FT; 254/264

[58] Field of Search ..... 226/186, 176, 226/177, 90, 89; 166/77.51; 254/30, 134.3 R, 134.3 FT, 264, 265

[56] References Cited

U.S. PATENT DOCUMENTS

| | | | |
|---|---|---|---|
| 598,527 | 2/1898 | Michael | 254/30 |
| 1,387,944 | 8/1921 | Price | 254/30 |
| 2,820,607 | 1/1958 | Dawes | 254/30 |
| 3,149,412 | 9/1964 | Curfman et al. | 254/30 X |
| 3,310,210 | 3/1967 | Reib | 226/176 X |
| 3,376,933 | 4/1968 | Burlett | 254/30 |
| 3,871,618 | 3/1975 | Funk | 226/187 X |
| 4,971,293 | 11/1990 | Roberson, Jr. | 254/265 |

*Primary Examiner*—Michael Mansen

[57] ABSTRACT

A well pump puller having a well casing collar including a coupling adapted to be tightly secured to a well casing and a frame support of legs upstanding from the coupling. A frame which is removably mounted on the support includes first and second u-shaped members pivotally mounted on one of the frame support legs. Wheels with well pipe engaging surfaces are rotatably mounted on each u-shaped member. Locking apparatus are provided for securing the u-shaped members together with the pipe engaging surfaces of the wheels on the u-shaped members above the coupling of the well case collar. A motor transmits power to the wheels on the first u-shaped member, to move well pipe relative to the casing. A crank on the second u-shaped member moves the wheel towards and away from the wheels on the first unshaped member. The frame may be mounted on a stand instead of a well casing collar.

2 Claims, 4 Drawing Sheets

PUMP PULLER

BACKGROUND OF THE INVENTION

1. Field of Invention

The present invention relates to pulling pumps from a well.

In the typical construction of a well, where the water supply may be hundreds of feet beneath the surface a submersible pump is positioned at or near the bottom of the well. The pump, suspended from the pipe which also acts as the conduit for the water, and electrical wiring for the pump must be driven to these depths when installing pumps or removing same when the pump or some portion of the piping must be replaced.

It is to an apparatus of this type to which the present invention is directed.

2. Description of Prior Art

The patent to Michael, U.S. Pat. No. 598,527; describes a lifting device for well tubing, with means to vary the tension upon the tube being elevated.

The patent to Price, U.S. Pat. No. 1,387,944 describes a well casing extractor with hingedly supported yoke frames and gripping rollers carried by the hinged frames.

Reib, U.S. Pat. No. 3,310,210, pertains to a device for pulling newly formed plastic pipe from an extrusion device through a vacuum sizer.

Burlett, U.S. Pat. No. 3,376,933 relates to a machine for lowering and raising lengths of pipe into and out of drilled wells and in which the pipe is gripped between a pair of pneumatic tires and power means are provided to rotate at least one of the tires to move the lengths of pipe along an axis into and out of the well.

Funk U.S. Pat. No. 3,871,618, is similar to Burlett, U.S. Pat. No. 3,376,933, but, in addition to the two tires as wheels on the base of the machine, a third well pipe engaging wheel is carried on a support member.

Common problems associated with prior art pump pulling apparatus are that they are labor intensive and it is often difficult to access wells and casings in environments that are rugged or challenging geographies. Also because of their size and weight, they are not truly a one man operation.

SUMMARY OF INVENTION

An object of the invention is a pump puller of simple, adaptable design.

Another object is such a design that is lightweight.

Still another object is such a design that allows for good visibility and access to the pump.

These and other objects, features and advantages of the present invention are accomplished in accordance with the teaching of the present invention, one illustrative embodiment of which comprises a well pump puller comprising a well casing collar including a coupling adapted to be tightly secured to a well casing and a frame support of legs upstanding from the coupling. A frame which is removably mounted on the support includes first and second u-shaped members pivotally mounted on one of the frame support legs. Wheels with well pipe engaging surfaces are rotatably mounted on each u-shaped member. Locking means are provided for securing the u-shaped members together with the pipe engaging surfaces of the wheels on the u-shaped members above the coupling of the well case collar. A motor transmits power to the wheels on the first u-shaped member, to move pipe relative to the casing. A crank on the second u-shaped member moves the wheel towards and away from the wheels on the first u-shaped member. The frame may be mounted on a stand instead of a well casing collar.

BRIEF DESCRIPTION OF THE DRAWING

Other objects, features and advantages of the invention will be apparent from the following detailed description and accompanying drawing wherein.

DESCRIPTION OF THE PREFERRED EMBODIMENT

Figure 1:
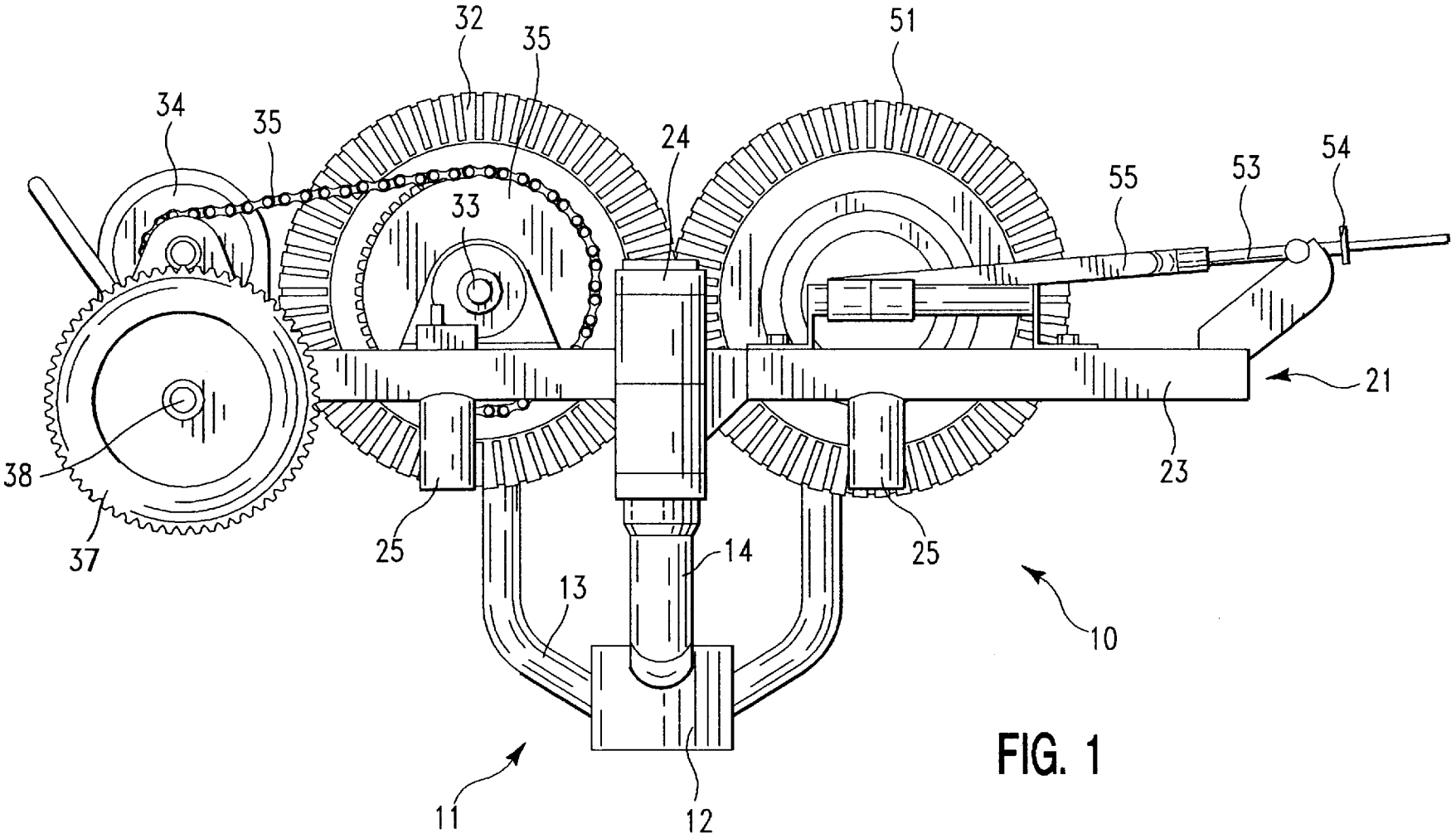
FIG. 1 is a side elevation view of the novel pump puller of the present invention.

Referring now to FIG. 1 of the drawing, the well pump puller 10 of the present invention is seen as having a well casing collar 11 including a coupling 12 and a frame support comprising legs, 13, 14, 15 extending upward from coupling 12, for example 1 ¼", #80 pipe, 45 degree angle.

Figure 5:
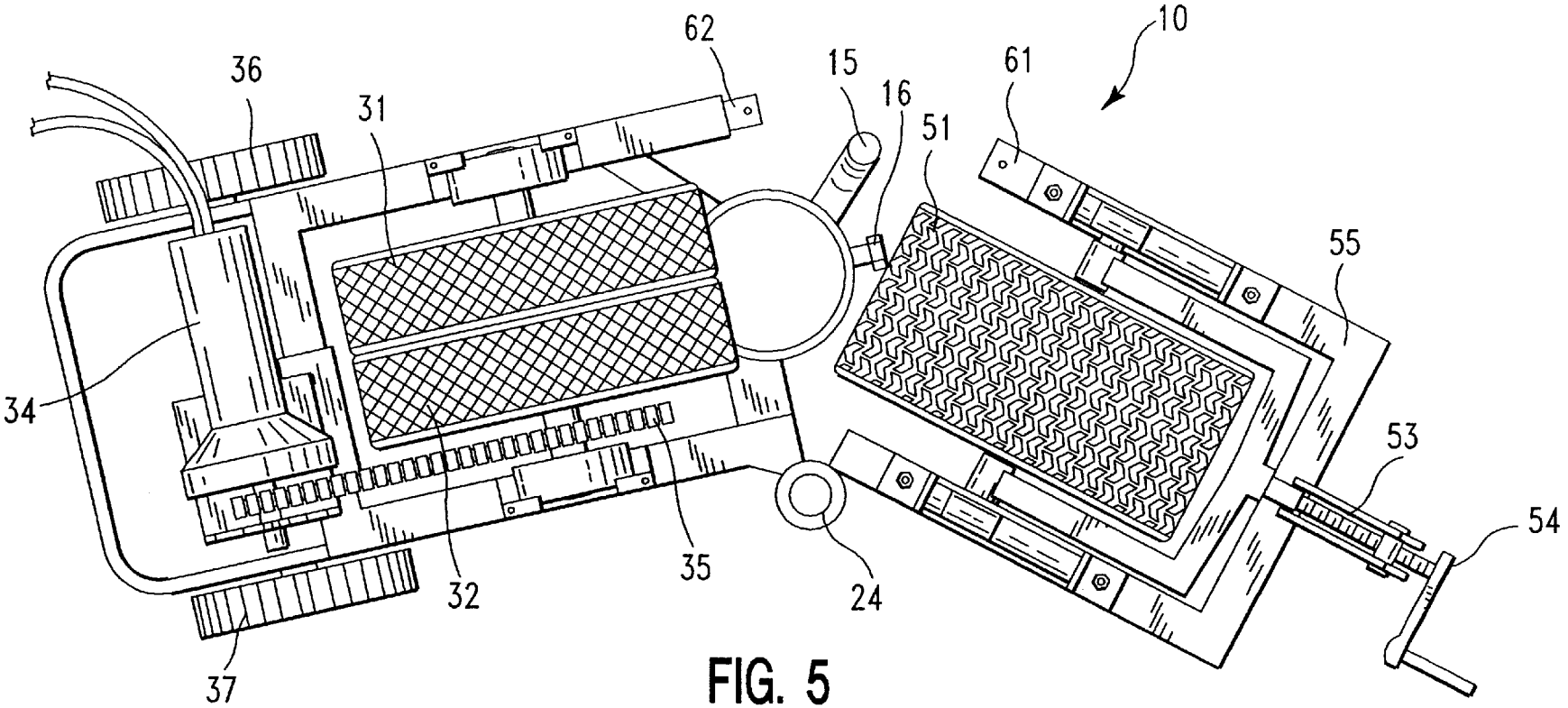
FIG. 5 is a top view of same but with frame in open position.

The coupling 12 is adapted to sit on and be secured to a well casing (not shown), tightly by means of set screws 16 (FIG. 5).

A frame generally designated 21 is removably mounted on the legs 13–15 of the frame support. It includes first 22 and second 23 u-shaped members pivotally mounted to a hinge mount 24 supported on leg 14.

The frame may be provided with nipples 25 for placement on a simple, retangular stand (not shown). One would use a stand instead of the well casing collar when the well is in a pit.

Figure 2:
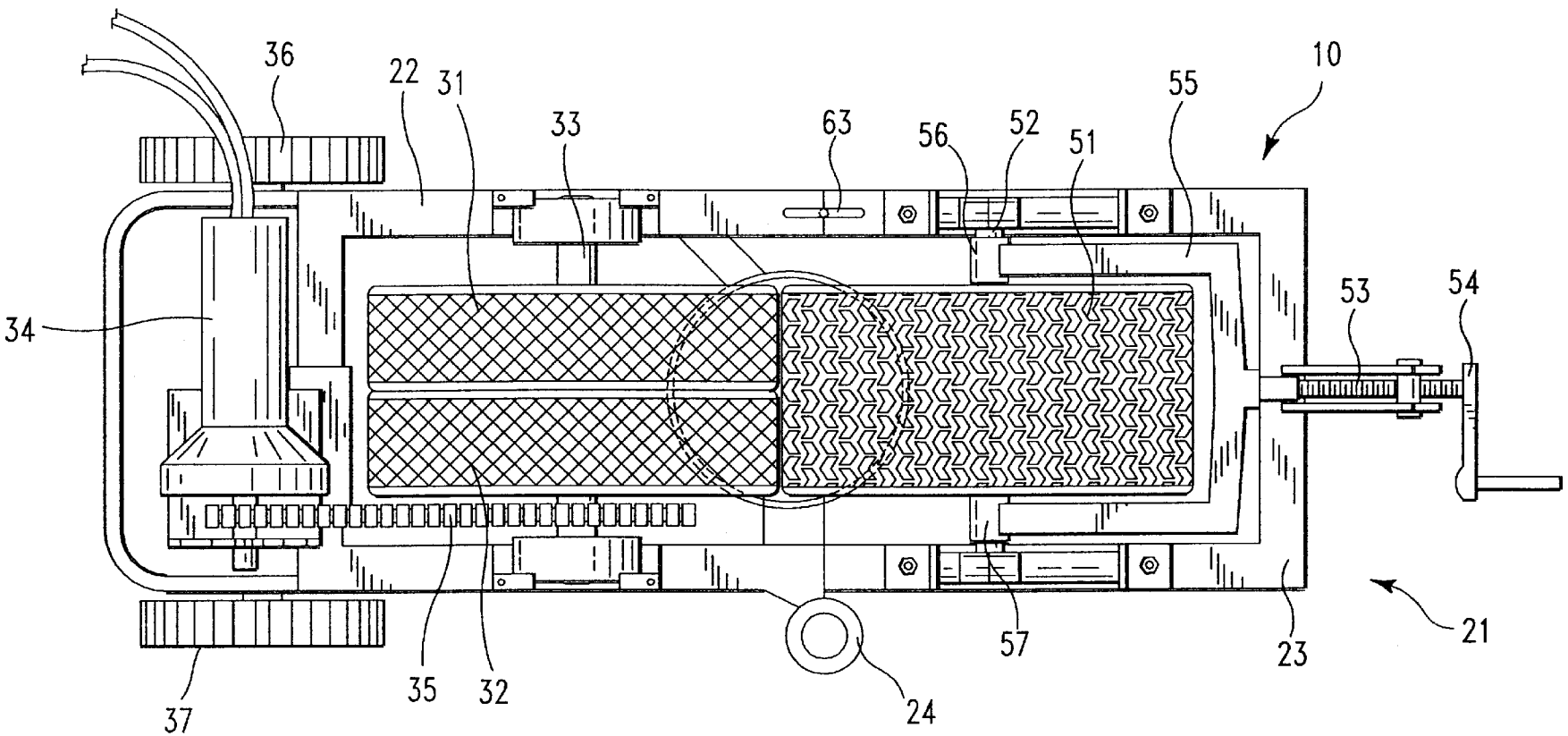
FIG. 2 is a top view of same.
Figure 3:
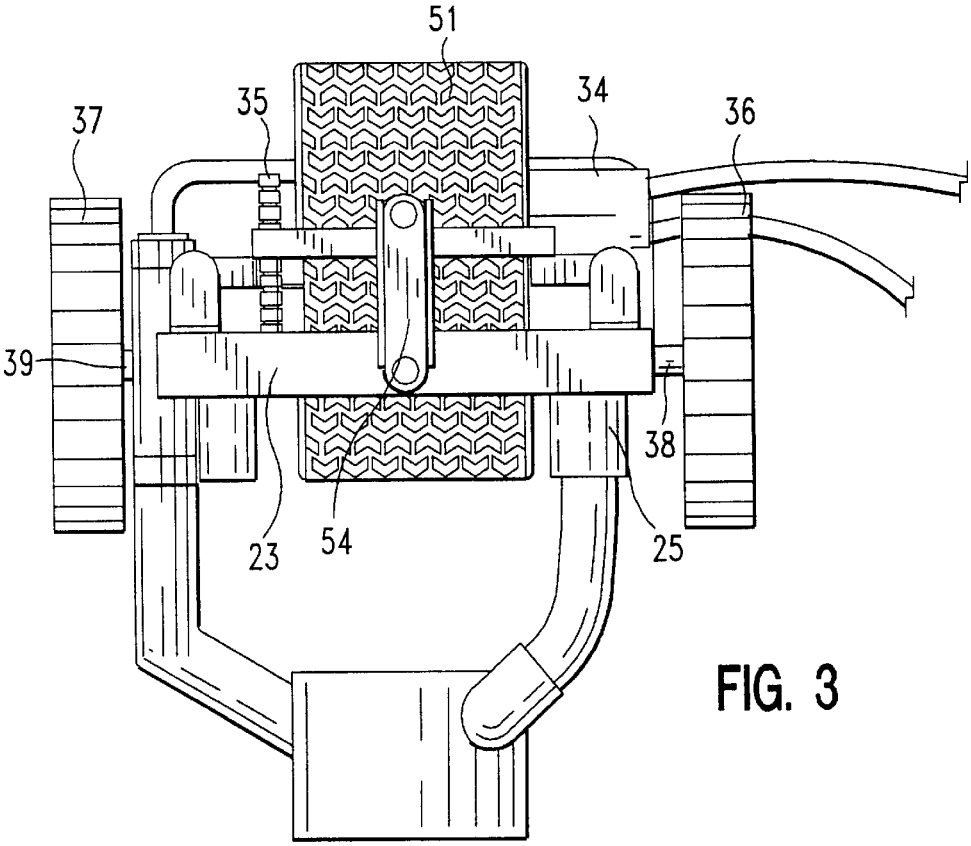
FIG. 3 is a front view of same.

A pair of wheels 31, 32 with pipe engaging surfaces, for example dual 4×10–6 wheels, is mounted to rotate on an axle 33 within u-shaped member 22 (See FIGS. 2, 3 and 5). With the dual wheels in side-by-side relationship, instead of at a 45 degree angle as on some prior art apparatus, the frame can be made to be smaller and more lightweight. Also, more drive power can be applied from my tires than with prior art apparatus.

A motor 34 transmits power to wheels 31, 32 via a chain drive 35. An electrical motor is shown, but a gasoline engine with gearing could be used. Upon activation of the motor 34 in one of two directions, the wheels 31, 32 are rotated in one of two directions to either remove well pipe from or lower well pipe into the ground through the well casing. The motor 34 can be a 115 volt electric winch with hand held electric drive control.

Figure 4:
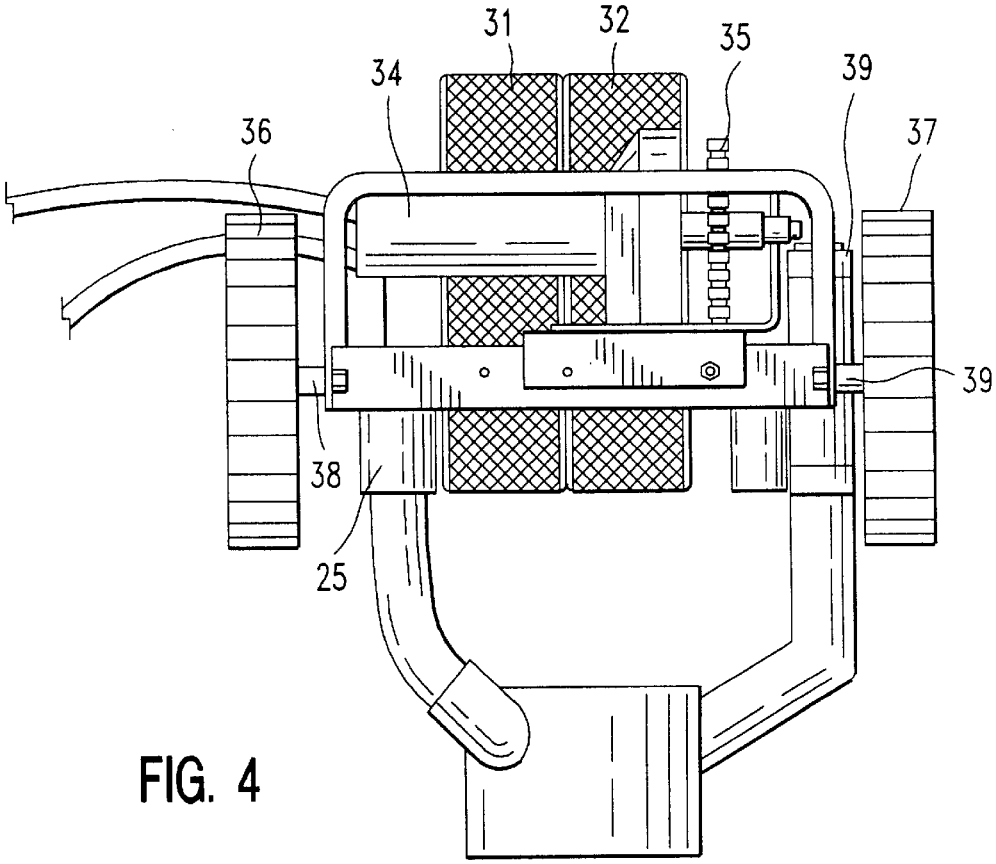
FIG. 4 is a rear view of same.

A second pair of wheels 36, 37, for example 8 inch lawn mower wheels, is mounted to axles 38, 39 on the outside of the lower portion of u-shaped member 22 for wheeling the well pump puller 10 to a well site (See FIGS. 2, 4 and 5).

Another wheel 51, for example a 13×6.5 turf tire, with pipe engaging surface is mounted to rotate on an axle 52 slidably held within u-shaped member 23. A crank 53 with handle 54 is affixed to a fork 55 with cylindrical pieces 56, 57 at its ends surrounding the axle 52. Turning of the crank 54 moves tire 51 toward and away from the tires 31, 32 when over the well casing collar 11.

In an open position frame 21 simply rests and is supported on leg 14. In a closed position the end 61 of u-shaped member 22 is slidably engagable within the end 62 of u-shaped member 23. Both ends are apertured so that a pin 63 may be dropped through the ends 61, 62 thus securing the frame 21 together (See FIG. 2).

In use the well pump puller 10 is wheeled to the well site using handle 54 to pull.

Well casing collar 11 is first mounted on top of a well casing (not shown). The coupling 12 is tightened on the casing by adjustment of set screws 16.

The frame 21 is lifted and hinge mount 24 is placed on leg 14 of the frame support.

With the frame in open position (FIG. 5) a well pipe (not shown) is introduced through the well casing collar 11 into the space between the wheels 31, 32 and wheel 51. With the frame in open position good access and visibility to the pump and pump area is provided. The wheels pull back out of the way and do not obstruct the view as with prior art fixed frame apparatus.

The frame 21 is then closed (FIGS. 1 and 2) and the pipe engaging surfaces of the wheels 31, 32 and 51 come in contact with the well pipe.

In the closed position the frame 21 will rest on legs 13 and 15 as well.

The handle 54 of the crank 53 may be turned to adjust the amount of pressure brought to bear against the well pipe. It is seen that the pump puller of the present invention will accommodate different sized well pipes.

Motor 34 may then be activated, to rotate tires 31, 32 so as to either remove well pipe from or lower well pipe into the ground through the well casing.

When the job is completed the frame 21 is removed from its support, the well casing collar is removed from the well casing and the well pump puller may be wheeled from the well site.

One man can operate the pump puller; thus labor (time, force, equipment) is reduced.

The pump puller is smaller in dimension than prior art structures, being only about half the size and weight of other pump pullers currently in use with fewer moving parts. Its construction is simple, portable and its power source adaptable. It is easily transported by a single technician and can be used in diverse, cumbersome geographies and working conditions.

It should be obvious that changes, additions and omissions may be made in the details and arrangement of parts without departing from the scope of the invention as defined in the appended claims.

What is claimed is:

1. A well pump puller comprising:

a mount;

a frame including first and second pivotable u-shaped members removably supported on the mount and adapted for movement in a horizontal plane toward and away from each other and for positioning over the casing of a well;

wheels with radially deformable well pipe engaging surfaces rotatably mounted on each u-shaped member and adapted for engagement and disengagement of the surface of a pipe upon movement of the u-shaped member toward and away from each other;

locking means for securing the u-shaped members together with the pipe engaging surfaces of the wheels on the u-shaped members above the well casing;

drive means mounted on the first u-shaped member for rotating the wheels on the first u-shaped member to move the pipe relative to the casing; and, crank means mounted on the second u-shaped member for moving the wheel on the second u-shaped member relative to the wheels on the first u-shaped member.

2. A well pump puller comprising:

a well casing collar including a coupling adapted to be tightly secured to a well casing and a frame support comprising legs extending from the coupling;

a mount supported on one of the frame support legs;

a frame including a first and second pivotable u-shaped members removably supported on the mount and adapted for movement in a horizontal plane toward and away from each other and for positioning over the casing of a well;

wheels with radially deformable well pipe engaging surfaces rotatably mounted on each u-shaped member and adapted for engagement and disengagement of the surface of a pipe upon movement of the u-shaped members toward and away from each other;

locking means for securing the u-shaped members together with the pipe engaging surfaces of the wheels on the u-shaped members above the coupling of the well casing collar;

drive means mounted on the first u-shaped member for rotating the wheels on the first u-shaped member to move the pipe relative to the casing; and, crank means mounted on the second unshaped member for moving the wheel on the second u-shaped member relative to the wheels on the first u-shaped member.

* * * * *